United States Patent [19]

Takagi et al.

[11] 3,962,992

[45] June 15, 1976

[54] DEVICE FOR DEVELOPING AN ELECTROSTATICALLY CHARGED IMAGE

[75] Inventors: Michiyasu Takagi, Yokohama; Toshihiko Oguchi, Kawasaki, both of Japan

[73] Assignee: Tokyo Shibaura Electric Co., Ltd., Kawasaki, Japan

[22] Filed: Oct. 25, 1974

[21] Appl. No.: 518,211

[30] Foreign Application Priority Data

Oct. 26, 1973 Japan ..... 48-119990

[52] U.S. Cl. ..... 118/637; 118/623; 427/18

[51] Int. Cl.[2] ..... G03G 15/08

[58] Field of Search ..... 427/18; 346/74 MP, 74 ES; 96/1 SD; 118/621, 623, 638, 639, 640, 637; 355/3 DD

[56] References Cited

UNITED STATES PATENTS

| | | | |
|---|---|---|---|
| 2,910,963 | 11/1959 | Herman | 118/637 |
| 3,117,891 | 1/1964 | Lehmann | 355/3 DD |
| 3,611,991 | 10/1971 | Young | 118/623 |
| 3,839,029 | 10/1974 | Berg et al. | 96/1 SD |

*Primary Examiner*—Mervin Stein
*Assistant Examiner*—Douglas Salser
*Attorney, Agent, or Firm*—Cushman, Darby & Cushman

[57] ABSTRACT

A device develops an electrostatically charged image formed on a photoelectroconductive layer with toner particles bearing a residual magnetization. The toner particles are provided on a vessel and in an alternating magnetic field to be rotated and repeatedly rebounded while charged, so as to be attracted onto the charged image.

11 Claims, 5 Drawing Figures

DEVICE FOR DEVELOPING AN ELECTROSTATICALLY CHARGED IMAGE

This invention relates to a device for developing an electrostatically charged image in an electronic copying machine and in particular to a device for developing an electrostatically charged latent image into a visual image.

In an electrophotography in general, an electrostatically charged latent image is formed onto a photoelectroconductive layer by electrostatically charging in a dark chamber, by virtue of a corona discharge, all the surface of the photoelectroconductive layer coated on an electroconductive plate and then exposing that pattern of the electrophotoconductive layer corresponding to an image to thereby effect a discharge.

The latent image is developed by a developing agent into a visual image. The amount used of the developing agent is so controlled by a magnet bar, that a supply of the developing agent onto the electrostatically charged image and removal of the excess developing agent from the electrostatically charged image are easily effected. Further, carrier iron powders act as an opposite electrode (developing electrode) to cause an electric field created by the electrostatically charged image to be uniformly distributed under an intense electric field toward the developing electrode. Thus, a magnetic brush method under which there is not involved an edge effect as encountered in a cascade method is often employed as a developing method.

In the above-mentioned magnetic brush method, a bulky and complicated developing device is required in an attempt to move (or rotate) a magnet to form a magnetic brush. The reason why the magnetic brush method is advantageous in effecting a development over a extended area (no edge effect is involved) resides in that carrier iron powders are electroconductive and that the magnetic brush per se acts as a developing electrode. However, there is a disadvantage that charges built up onto a photoelectroconductive layer leak through the electroconductive carrier to cause a developing image to be fogged. This is often observed where the photoelectroconductive layer is made of selenium. Therefore, the electroconductivity of the carriers should be great enough not to prevent effects produced by the developing electrode and small enough not to prevent a leak of charges built up onto the photoelectroconductive layer. This adjustment is difficult. Furthermore, since the electroconductivity of the magnetic brush as a whole is dependent upon an amount of toner, difficulty is also encountered in adjusting the electroconductivity of the carrier. It is very difficult to obtain at all times a stable characteristic irrespective to the amount of toner. Moreover, at a developing time the magnetic brush is contacted directly with the surface of the photoelectroconductive layer to cause it to be worn away or stained. Particularly when carrier particles have sharp edges, a multitude of scratches or mass are formed on the surface of the photoelectroconductive layer, leading to the degradation of the characteristic of the photoelectroconductive layer.

As an improved magnetic brush method it is known to form a brush on a non-magnetic cylinder using a toner to which a magnetosensitivity is imparted. In this method a development is effected, while an electrostatically charged image is maintained in a manner to be slightly contacted with the brush. Since, however, carriers are not used, the napping of the brush is insufficient. In order to cause the brush to be properly contacted with an electrostatically charged image, a space between the non-magnetic cylinder and the electrostatically charged image is required to be much more accurately set than in the above-mentioned magnetic brush method. In this case it is impossible to impart a sufficient charge to the toner as in the case where magnetic carriers are employed. Therefore, a clear-cut image cannot be obtained. In order to avoid this drawback an attempt has been made to cover the surface of a magnetic toner with an electroconductive carbon thus rendering it electroconductive. Even in this case, however, charges built up on the photoelectroconductive layer may leak and it is difficult to make a transfer.

It is accordingly the object of this invention to provide a developing device which is simple in construction and capable of obtaining a clear-cut image without requiring any high accuracy designing.

According to one aspect of this invention there is provided a device for developing an electrostatically charged image formed on a photoelectroconductive layer, comprising a supporting member disposed at a predetermined interval below the photoelectroconductive layer, toner particles placed on the supporting member and bearing a residual magnetization, and alternating magnetic field generating means for applying an alternating magnetic field to the toner particles to cause the latter to be rotated, while repeatedly rebounding on the supporting member, causing the toner particles to be electrically charged to permit the charged toner particles to be deposited onto the electrostatically charged image.

This invention can be more fully understood from the following detailed description when taken in conjunction with the accompanying drawings, in which.

Figure 1:
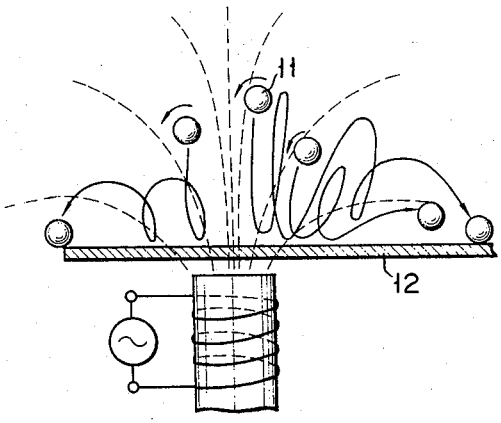
FIGS. 1 and 2 are cross-sectional views of devices for explaining the principle of a developing device according to this invention.

As shown in FIG. 1, when an alternating magnetic field electromagnet is applied to permanently magnetized toner particles 11 disposed on a non-magnetic plate 12, toner particles are randomly rebounded relatively high, while being rotated, and moved gradually toward a weaker magnetic field side and finally stopped at a weak magnetic field where they are not rotated. While the toner particles are being rebouned, they are electrified. Such a phenomenon was discovered by the inventors, and the reason for this will probably be explained below.

Figure 2:
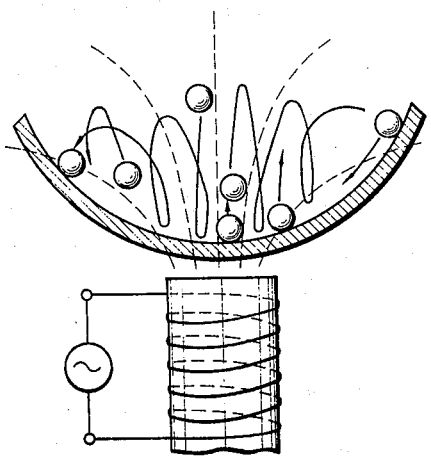

Generally, when a permanently magnetized particles are disposed under an alternating magnetic field, if the magnetic moment of the particles is greater than the inertial moment thereof during the rotation of the particles, the particles are rotated in synchronism with the alternating field. While the particles are so rotated, they collide with each other to cause them to be rebounded high. When the rebounded particles strike against the bottom of a vessel, they are electrically charged. Consequently, if the rebounding of the particles is repeated, the particles will be rebounded relatively high and a predetermined amount of charges will be built up. If a plate is disposed at a predetermined interval above the vessel with its electrostatically charged surface kept downward, the toner will be deposited on the electrostatically charged surface of the plate by the polorization of the toner as well as a static electricity between the toner and the electrostatically charged surface of the plate. If, therefore, suitable means are provided for preventing the toner from being moved toward a weaker magnetic field, for example, use is made of a non-magnetic vessel arcuate (FIG. 2) or rectangular in cross section, the toners are always rebounded under an alternating magnetic field.

A developing device according to this invention is based on the above-mentioned phenomenon. Namely, when an alternating field is applied to a permanently magnetized toner disposed on a predetermined object, the toner particles are rebounded on the object, while being electrostatically charged. If, therefore, a photoelectroconductive material coated plate whose surface is electrostatically charged is provided, within a rebounding range of the toner particles, above the object, the toner particles are deposited on the electrostatically charged image built up on the plate.

The rebounding distance of the toner particles is predominantly dependent upon the intensity of the alternating magnetic field and the residual magnetization (B*r*) of the toner particle. Even when the residual magnetization of the toner particle is small, if the strength of the alternating magnetic field is sufficiently large, the toner particles can obtain a magnetic moment sufficient to be rotated while being rebounded. If, on the other hand, the residual magnetization of the toner particles per se is great, the toner particles can be actively rebounded even under a weaker magnetic field. The intensity of remnant magnetism of the toner can be easily determined by, for example, compressing the toner under a pressure of about 10 ton/cm$^2$ to form a rod and then plotting the magnetization curve of the rod. Various samples were prepared by varying the kind and content of magnetic material in the toner, and the magnetization of the sample was determined using the above-mentioned method. Upon examination of a relation between the residual magnetization and rebounding distance of the toner those samples whose remanances are on the order of at least 10 gausses were found preferable. If, for example, the residual magnetization of the toner is 10 gauss and the particle size of the toner is in a range of 5 to 15$\mu$, a rebounding height of several millimeters could be obtained under an alternating magnetic field of 3000A-turns. When the whole width of the developing device is 30 cm (development can be made with respect to a photoelectroconductive layer 30 cm in width), if a three-phase rotating magnetic field is used as the alternating magnetic field, about 20W consuming power will be required in the developing device in an attempt to obtain a magnetic field of 3000A-turns. If the intensity of the alternating field is further increased by increasing the consuming power, those toners having a residual magnetization of below 10 gauss can be rebounded up to a predetermined height. When a magnetic field of 3000A-turns was applied to those toners having a residual magnetization of about 500 gauss, the toner particles were rebounded up to a height of more than 10 mm. To make the rebounding of the toner particles easy and attain a high toner particle fluidization, the toner particle is preferred to have a spherical shape. The toner is also preferred to have a particle size of more than 5$\mu$ in an attempt to prevent coagulation of toner particles.

Figure 3:
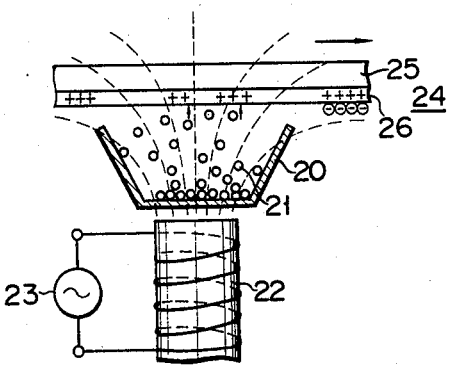
FIG. 3 is a cross-sectional view of a developing device according to one embodiment of this invention.

There will now be explained one embodiment of this invention by reference to FIG. 3.

Permanently magnetized toner particles 21 are received within an open topped vessel 20 made of a non-magnetic material, for example, aluminum, brass, etc. Below the vessel is disposed an electromagnet 22 connected to a power source circuit having a single-phase AC power source 23. An alternating magnetic field as indicated in broken lines in FIG. 3 is generated by an AC current from the power source 23. A master 24 is provided at a predetermined interval above the vessel 20 and is movable in a direction indicated by an arrow. The master 24 is well known in this field and has an electroconductive base 25 and a photoelectroconductive layer 26. An electrostatically charged latent image is formed by a known technique on the photoelectroconductive layer 26. When an alternating magnetic field is induced by the magnet 22, the toner particles 21 in the vessel 20 are rebounded as above-mentioned and deposited onto the electrostatically charged image of the photoelectroconductive layer 26, thus effecting a development. For increasing changing effect of toner particles it is preferred that an electroconductive material such as aluminum be coated on the inner surface of the vessel 20. In some case, a material capable of easily imparting charges to the toner may be coated on the inner surface of the vessel.

In an embodiment shown in FIG. 4 three electromagnets 22 are disposed below a toner receiving vessel 20. Alternating currents phase shifted, for example 120°, from each other are applied to these three electromagnets. As a result, a rotating magnetic field is generated by the combination of three electromagnets. Under the rotating magnetic field the toner particles 21 within the vessel 20 are moved, while rebounding, in a direction opposite to that of the rotating magnetic field and deposited on an electrostatically charged image formed on a photoelectroconductive layer 26 of a plate which is disposed at a predetermined interval above the vessel and rotated in a direction indicated by an arrow. As a result, a development is effected.

Figure 4:
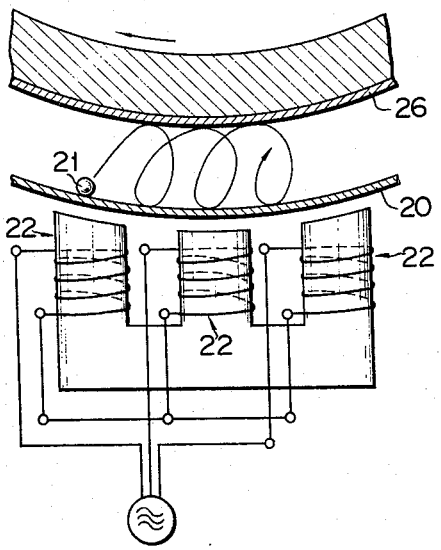
FIG. 4 is a cross-sectional view of a developing device according to another embodiment of this invention.
Figure 5:
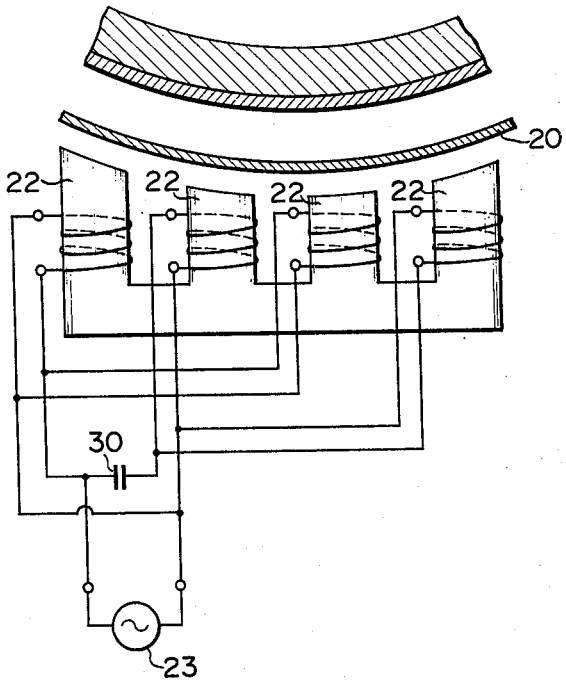
FIG. 5 is a cross-sectional view of a modification of the developing device of FIG. 4.

Though with the embodiment shown in FIG. 4 three-in-a-set electromagnet is used, this invention is not restricted to this embodiment. For example, a plurality of three-in-a-set magnets may be juxtaposed so that three phase AC voltages can be sequentially applied. In this construction, a developing electrode can be made elongated. If any two phase of three phase AC voltages are switched at a suitable cycle so as to prevent the toner particle from being moved outside the range of a rotating field, the direction of the rotating magnetic field is reversed at that cycle and, in consequence, the toner particles can be reciprocably moved. In the embodiment of FIG. 4 the three phase AC power source is employed. If, however, a circuit arrangement as shown in FIG. 5 is used, a rotating magnetic field can be created, without a need of any particular power source, by using, for example, the same single phase AC power source as that of a copying machine. In the arrangement of FIG. 5 four electromagnets 22 are disposed below a vessel 20 and the first and third electromagnets are connected to an AC power source 23 in a manner to be applied with voltages of 180°C-phase shifted, while the second and fourth electromagnets are connected to the AC power source through an electrical part 30 such as a capacitor, choke coil, etc., to have 180°C-phase shifted which is designed to impart a $\pi/2$ phase difference. If a plurality of four-in-a-set electromagnets are arranged in parallel, it is possible to make a developing electrode elongated. Even in this case, if applied voltages are switched at a suitable cycle, the toner particles can be reciprocably moved.

The above-mentioned toner may be formed, for example, by thermally kneading in a colored thermoplastic resin needle-like magnetic powders of $Fe_3O_4$ for a magnetic tape whose average particle size is $0.3\mu$, by crushing them, by selecting a prescribe size of particles and by magnetizing them to have a coersive force of 400 oersteds and residual magnetization of 500 gauss. The residual magnetization of the toner is substantially proportional to a mixed ratio of the magnetic material with the resin. Where the magnetic material is about 50 weight percent, the residual magnetization of the toner will be about 250 gauss. Where it is 20 weight percent, the residual magnetization will be about 120 gauss. Where it is 5 weight percent, the residual magnetization will be about 25 gauss. As the magnetic material constituting the toner, use may be made of material for a permanent magnet, such as KS steel, Alnico, carbon steel, tungsten steel, bismanal ferroxdure (trade mark) $\gamma Fe_2O_3$, rare earth metal, etc., in addition to the above-mentioned $Fe_3O_4$. As the thermoplastic resin use may be made of epoxy resin, styrene resin, vinyl chloride resin acrylic resin, polyester resin and copolymer thereof.

Since with the above-mentioned developing device according to this invention the toner particles are moved, while rebounding, by the magnetic means, a better development can be made, without the necessity of very accurately determining a distance between the photoelectroconductive layer and the developing electrode (non-magnetic plate), by depositing the rebounded toner particles onto an electrostatically charged image.

What we claim is:

1. In combination, a device for developing an electrostatically charged image formed on a photoelectroconductive layer, comprising a supporting member disposed at a predetermined interval below the photoelectroconductive layer and including a vessel made of magnetic flux passing material, toner particles placed on the supporting member and bearing a residual magnetization, and alternating magnetic field generating means for applying an alternating magnetic field to said residually magnetized toner particles to cause the latter to be rotated, while repeatedly rebounding on the supporting member, causing the toner particles to be electrically charged to permit the charged toner particles to be deposited onto the electrostatically charged image and a quantity of said residually magnetized toner particles.

2. In a combination of developing device and toner particles according to claim 1, in which said alternating magnetic field generating means includes an electromagnet disposed below the supporting member and an AC source for applying AC voltages to the electromagnet.

3. A device for developing an electrostatically charged image formed on a photoelectroconductive layer, comprising a supporting member disposed at a predetermined interval below the photoelectroconductive layer, toner particles placed on the supporting member and bearing a residual magnetization, and alternating magnetic field generating means for applying an alternating magnetic field to the toner particles to cause the latter to be rotated, while repeatedly rebounding on the supporting member, causing the toner particles to be electrically charged to permit the charged toner particles to be deposited onto the electrostatically charged image including an electromagnet disposed below the supporting member and an AC source for applying AC voltages to the electromagnet, and wherein said supporting member includes an open-topped vessel made of a non-magnetic and electroconductive material.

4. In a combination of developing device and toner particles according to claim 1, in which said alternating magnetic field generating means includes a plurality of electromagnets disposed below the supporting member and a power source circuit for applying an AC voltage to the respective electromagnets.

5. A device for developing an electrostatically charged image formed on a photoelectroconductive layer, comprising a supporting member disposed at a predetermined interval below the photoelectroconductive layer, toner particles placed on the supporting member and bearing a residual magnetization, and alternating magnetic field generating means for applying an alternating magnetic field to the toner particles to cause the latter to be rotated, while repeatedly rebounding on the supporting member, causing the toner particles to be electrically charged to permit the charged toner particles to be deposited onto the electrostatically charged image including a plurality of electromagnets disposed below said supporting member and a power source circuit for applying an AC voltage to the respective electromagnets, said plurality of electromagnets being divided into at least one group consisting of three electromagnets and said power source circuit including a three phase power source for applying to the three electromagnets AC voltages which are phase-shifted 120° from each other.

6. A device for developing an electrostatically charged image formed on a photoelectroconductive layer, comprising a supporting member disposed at a predetermined interval below the photoelectroconductive layer, toner particles placed on the supporting member and bearing a residual magnetization, and alternating magnetic field generating means for applying an alternating magnetic field to the toner particles to cause the latter to be rotated, while repeatedly rebounding on the supporting member, causing the toner particles to be electrically charged to permit the charged toner particles to be deposited onto the electrostatically charged image including a plurality of electromagnets disposed below said supporting member and a power source circuit for applying an AC voltage to the respective electromagnets, said plurality of electromagnets being divided into at least one group consisting of two electromagnets, and said power source circuit including a single phase AC source and a circuit for connecting the electromagnets to the source so that one of the electromagnets of the group is supplied with an AC voltage which is phase shifted by $\pi/2$.

7. In a combination of developing device and toner particles according to claim 1, in which said toner is a mixture of a magnetized material and a colored synthetic resin.

8. In a combination of developing device and toner particles according to claim 7, in which said toner has a residual magnetization of at least 10 gauss.

9. A developing device according to claim 5, in which said electromagnets are driven to change the direction of a rotating magnetic field.

10. A developing device according to claim 6, in which said electromagnets are driven to change the direction of a rotating magnetic field.

11. In a combination of a developing device and toner particles according to claim 1, in which said vessel is made of electroconductive materials.

* * * * *